United States Patent [19]

Samejima et al.

[11] 4,244,042

[45] Jan. 6, 1981

[54] ALARM TIMEPIECE

[75] Inventors: Toshihide Samejima; Nakanobu Moritani; Hajime Oda; Masanori Fujita, all of Tokyo, Japan

[73] Assignee: Kabushiki Kaisha Seikosha, Tokyo, Japan

[21] Appl. No.: 926,633

[22] Filed: Jul. 21, 1978

[30] Foreign Application Priority Data

Jul. 29, 1977 [JP] Japan ..... 52-91990

[51] Int. Cl.[3] ..... G04B 23/02; G04C 21/16

[52] U.S. Cl. ..... 368/73; 368/251

[58] Field of Search ..... 58/18, 19 A, 19 B, 19 C, 58/21.15, 38 R, 57.5, 152 B

[56] References Cited

U.S. PATENT DOCUMENTS

| | | | |
|---|---|---|---|
| 4,016,562 | 4/1977 | Gerum | 58/38 R |
| 4,074,516 | 2/1978 | Kondo | 58/38 R |
| 4,095,410 | 6/1978 | Kaneko | 58/38 R |
| 4,104,861 | 8/1978 | Yoda et al. | 58/38 R |
| 4,152,887 | 5/1979 | Fukuichi | 58/57.5 |

FOREIGN PATENT DOCUMENTS

| | | | |
|---|---|---|---|
| 1389208 | 4/1975 | United Kingdom | 58/21.155 |

*Primary Examiner*—J. V. Truhe
*Assistant Examiner*—Forester W. Isen
*Attorney, Agent, or Firm*—Robert E. Burns; Emmanuel J. Lobato; Bruce L. Adams

[57] ABSTRACT

An alarm timepiece operates such that after an acoustic alarm generated at a preset alarm time has been stopped, the alarm timepiece is automatically so set as to regenerate the acoustic alarm at the next preset alarm time. The generation of the acoustic alarm is compulsorily stopped during the adjusting of time, and when the acoustic alarm is stopped by manipulating a manual switch for suspension, the acoustic alarm is regenerated after a predetermined time has elapsed. When the acoustic alarm is generated for a predetermined time without being stopped by means of a manual switch, it is automatically stopped.

2 Claims, 1 Drawing Figure

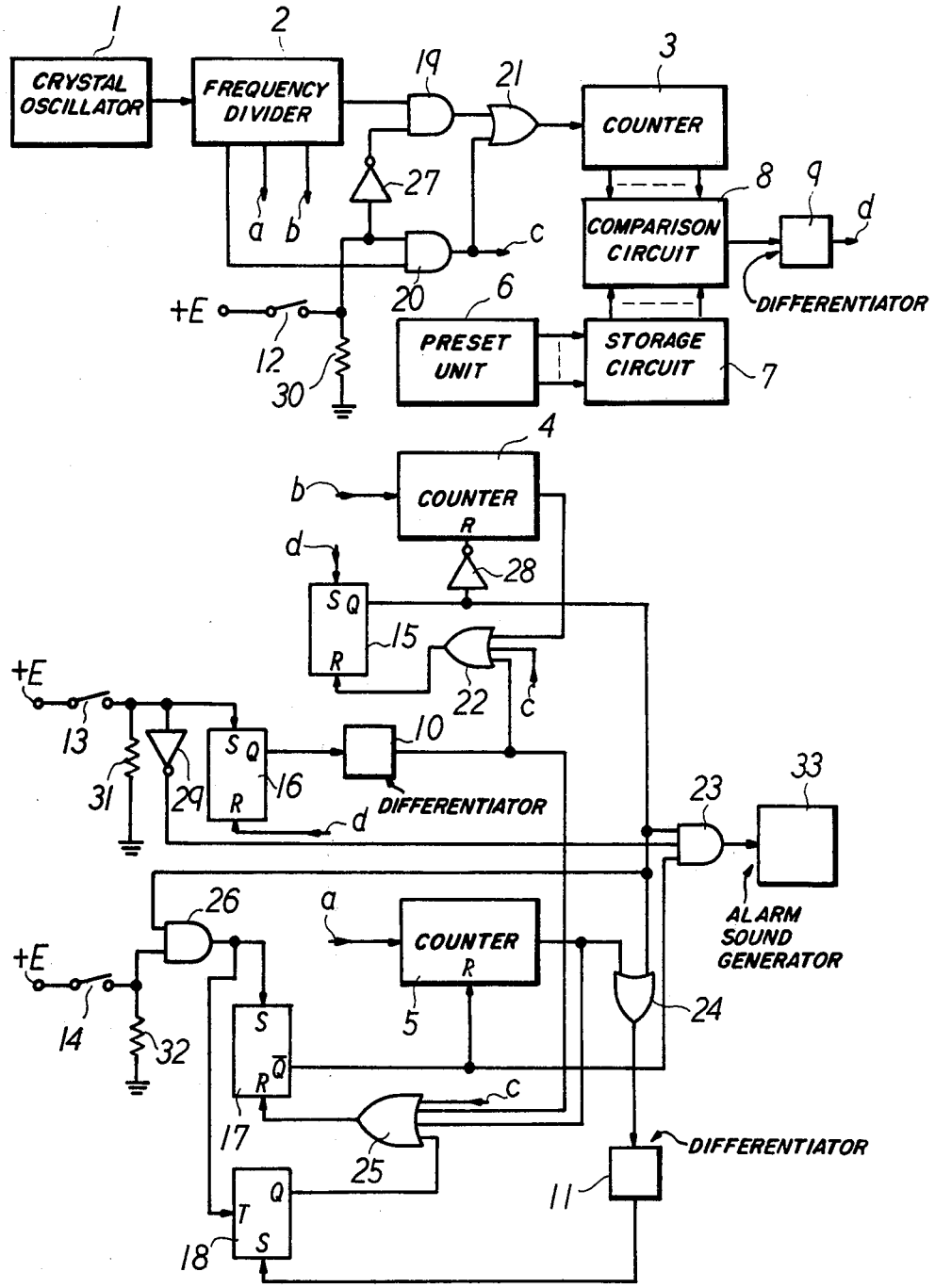
CRYSTAL OSCILLATOR
FREQUENCY DIVIDER
COUNTER
COMPARISON CIRCUIT
DIFFERENTIATOR
PRESET UNIT
STORAGE CIRCUIT
COUNTER
COUNTER
DIFFERENTIATOR
DIFFERENTIATOR
ALARM SOUND GENERATOR
+E
+E
+E

ALARM TIMEPIECE

BACKGROUND OF THE INVENTION

This invention relates to an alarm timepiece.

Heretofore a crystal alarm timepiece is known in which as the push-button for stopping the acoustic alarm is released after being depressed, the acoustic alarm is regenerated after several minutes have elapsed since the suppression of the acoustic alarm, and as the push-button is rotated a predetermined angle while in a depressed condition, it is held in the depressed condition to terminate the acoustic alarm. In such an alarm timepiece, it was troublesome in the manipulation for stopping the acoustic alarm and in that the user must release the depressed push-button before going to sleep each day.

SUMMARY OF THE INVENTION

This invention relates to an improved alarm timepiece which overcomes the difficulties of the above-described prior art.

It is one object of the invention to provide an alarm timepiece in which an acoustic alarm is generated at a preset alarm time and when it is stopped in response to on a manipulation of a manual switch, the alarm timepiece is automatically reset so as to regenerate the acoustic alarm at the next preset alarm time, and thus it is not necessary to preset the alarm time of the next day every day.

It is another object of the invention to provide an alarm timepiece in which the acoustic alarm is compulsorily stopped during the adjusting of time, thus the needles acoustic alarm is not generated.

It is a further object of the invention to provide an alarm timepiece in which a function for temporarily suspending the acoustic alarm is provided and further the acoustic alarm is automatically stopped when a predetermined time has elapsed, and thus the acoustic alarm is regenerated after a predetermined time has elapsed since the stopping of the acoustic alarm and further, even if the acoustic alarm is not stopped by manipulation of a manual switch, it is automatically stopped when a predetermined time has elapsed and thus electric power is not wasted.

BRIEF DESCRIPTION OF THE DRAWING

The nature of the present invention as well as other objects and advantages thereof will become more apparent from consideration of the following detailed description and the accompanying drawing in which:

The single FIGURE drawing shows a logic electric circuit of an embodiment of this invention.

DESCRIPTION OF THE PREFERRED EMBODIMENT

An embodiment of this invention will now be described with reference to the drawing. Referring now to the drawing, the high frequency output of a crystal oscillator 1 is lowered to four different frequencies by a frequency divider 2. A counter 3 counts the actual or current time upon receipt of clock pulses of lowered frequency from the frequency divider 2. A counter 4 counts pulses produced at a terminal b of the frequency divider 2 and produces a pulse when it counts three minutes. A counter 5 counts pulses produced at a terminal a of the divider 2 and produces a pulse when it counts thirty seconds. The present unit 6 comprises, for instance, such a means that logical values are produced in accordance with the condition that each of a plurality of manual switches is opened or closed and the logical outputs, namely the data of a desired alarm time, are read into a storage circuit 7. The comparison circuit 8 compares the current time data with the stored data in the storage circuit 7 and produces a pulse when the stored data coincides with the current time. A plurality of differentiators 9–11 differentiate trailing edge of their respective input pulses. Manual switches 12, 14 and 13 are provided for adjusting the current time, temporarily suspending an acoustic alarm and completely terminating the acoustic alarm, respectively. Reference numerals 15–18 denote flip-flop circuits; 19–26 denote gate circuits; 27–29 depict inverters; 30–32 represent resistors; and 33 denotes an alarm sound generator.

The manner of operation of the alarm timepiece will now be described. In an initial state, it is assumed that the flip-flop circuits 15, 16, 17 and 18 are reset, set, reset and set respectively and the manual switches 12, 13 and 14 are closed, opened and opened respectively. Thereupon, when the manual switch 12 is opened, the gate circuit 19 opens and thus the pulses from the frequency divider 2 are supplied to the counter 3 through the gate circuits 19, 21 to count the current time. In the meanwhile, the desired alarm time is preset in the storage circuit 7 by the preset unit 6. When the current time coincides with the above desired alarm time, the output of the comparison circuit 8 shifts to logical "1", which is differentiated by the differentiator 9 whose output causes the flip-flop circuits 15 and 16 to be set and reset respectively. Accordingly, one inputs one gate circuits 26 and 23 are kept at a logical "1" by the Q output of the flip-flop circuit 15, and the reset of the counter 4 is released. Thus, the counter 4 counts the pulses produced at the terminal b of the frequency divider 2. As the other two inputs of the gate circuit 23 are also kept at a logical "1" by the output of the inverter 29 and the $\overline{Q}$ output of the flip-flop circuit 17, the output of the gate circuit 23 shifts to a logical "1" to generate the acoustic alarm from the alarm sound generator 33.

When the manual switch 14 for temporarily suspending the acoustic alarm is closed, the output of the gate circuit 26 switches to logical "1" to shift the Q output of the flip-flop circuit 18 to a logical "0" and to set the flip-flop circuit 17. The output of the gate circuit 23 thus switches to a logical "0" by the $\overline{Q}$ output of the flip-flop circuit 17 to stop the acoustic alarm. In addition, the reset of the counter 5 is released by the above inverted level of the flip-flop circuit 17 and the counter 5 counts the pulses produced at the terminal a of the frequency divider 2.

When 30 seconds are counted by the counter 5, the output thereof shifts to a logical "1", which resets the flip-flop circuit 17 through the gate circuit 25. Consequently, the $\overline{Q}$ output of the flip-flop circuit 17 switches to a logical "1" whereupon the counter 5 is reset and the output of the gate circuit 23 switches to a logical "1" to regenerate the acoustic alarm from the alarm sound generator 33. In this manner, when the switch 14 is closed, the acoustic alarm is regenerated after the acoustic alarm has been suspended for thirty seconds.

In order to enable generation of the acoustic alarm at the preset alarm time of the next day after it has been once stopped, the manual switch 13 is opened after being once closed. As the manual switch 13 is closed, the flip-flop circuit 16 is set to invert the Q output thereof to a logical "1". Thus, a differentiated output from the differentiator 10 resets the flip-flop circuit 15 through the gate circuit 22 and resets the flip-flop circuit 17 through the gate circuit 25. When the flip-flop circuit 15 is reset, the output of the gate circuit 23 is inverted to "0" to stop the acoustic alarm.

As a coincidence output is produced again from the comparison circuit 8 at the same preset alarm time as described above on the next day, the flip-flop circuit 15 is set to generate the acoustic alarm in the same manner as described above.

If the manual switch 13 is held in the closed state, the output of the gate circuit 23 is kept at a logical "0" by the output of the inverter 29, and no acoustic alarm is generated when the actual or current time coincides with the present alarm time. In this manner, the acoustic alarm can be generated at the preset alarm time of the next day so long as the manual switch 13 is opened after having been once closed.

If the acoustic alarm is not stopped by the manual switch 13 or 14, the acoustic alarm is automatically stopped by such a manner that the counter 4 produces an output when three minutes have elapsed since the generation of the acoustic alarm and the flip-flop circuit 15 is reset to stop the acoustic alarm.

In some cases, it is necessary to produce an acoustic alarm at any time, this is required, for example, when a dealer demonstrates the function of the alarm timepiece to a customer, in which case it is inconvenient to have to keep the customer waiting for 30 seconds. To this end, the manual switch alarm is closed after once set for alarm suspension, and the acoustic alarm is generated immediately when the manual switch 14 is closed again. The operation is as follows. In a state when the flip-flop circuit 17 is set so as to temporarily suspend the acoustic alarm, the Q output of the flip-flop circuit 18 is kept at a logical "0" as described above. In this condition, when the manual switch 14 is closed again, the Q output of the flip-flop circuit 18 is inverted to a logical "1", which resets the flip-flop circuit 17 through the gate circuit 25. Accordingly, the $\overline{Q}$ output of the flip-flop circuit 17 is inverted to a logical "1", so that the output of the gate circuit 23 is inverted to a logical "1" to immediately generate the acoustic alarm from the alarm sound generator 33.

The operation of the time adjustment will be described next. The manual switch 12 is closed to close the gate circuit 19 and to open the gate circuit 20, and then the pulses from the frequency divider 2 are supplied to the counter 3 through the gate circuits 20 and 21. In the meanwhile, the pulses passed through the gate circuit 20 reset the flip-flop circuit 15 through the gate circuit 22 and reset the flip-flop circuit 17 through the gate circuit 25. This is on account of checking the generation of the acoustic alarm when the content of the counter 3 coincides with the stored alarm time in the storage circuit 7 during the adjusting of time.

In this embodiment, the generation of the acoustic alarm is controlled by the flip-flop circuits 15, 16 etc. However, it is possible to adopt such a manner that a one shot pulse generator which produces an output pulse having a long pulse width is triggered by an output from the differentiator 9 whose output pulse is applied as an input for controlling the gate circuit 23. Then, the acoustic alarm generates at the alarm time of the next day so long as the one shot pulse generator is reset by the switching output of the manual switch 13.

In this embodiment, the acoustic alarm is stopped during the adjusting of time by such a means that the flip-flop circuit 15 is reset by a time adjustment pulse from the gate circuit 20. However, it is possible to hold the flip-flop circuit 15 in a reset condition with the closing output of the manual switch 12.

As described above in detail, according to the invention, when the actual or current time coincides with the alarm time, an acoustic alarm is generated in response to a coincidence output and the alarm is stopped by manipulating a manual switch. Further, after the acoustic alarm has been generated, it is regenerated by the next coincidence output. Thus, the alarm time of the next day can be set at the same time when the acoustic alarm is stopped. Consequently, it is not necessary to preset the alarm time before going to sleep.

In addition, since the generation of the acoustic alarm is checked during the adjusting of time, even if the current time coincides with the preset alarm time, needless acoustic alarm is not generated.

Further, this invention has functions for suspending the acoustic alarm and for allowing automatic stopping of the acoustic alarm after a predetermined time. Thus, the acoustic alarm is repeatedly generated even if the acoustic alarm is stopped by manipulating a manual switch and further the acoustic alarm is automatically stopped even if the user forgets to stop it, so that a wasteful electric power is not spent.

What is claimed is:

1. An alarm timepiece comprising: time count means for counting time; first means for producing a coincidence output when the content of said time count means coincides with a preset alarm time; actuatable switching means operative when manually actuated for producing an output; an alarm sound generator operative when activated for generating an acoustic alarm; second means for enabling activation of said alarm sound generator in response to the coincidence output and preventing activation of said alarm sound generator in response to the output from said switching means and for enabling said alarm sound generator to activate again in response to the next coincidence output; time adjustment means for adjusting the content of said time count means; and control means operable irrespectively of actuation of said switching means for compulsorily stopping the generation of the acoustic alarm from said alarm sound generator during adjusting of said time count means.

2. An alarm timepiece comprising: time count means for counting time; first means for producing a coincidence output when the content of said time count means coincides with a preset alarm time; an alarm sound generator operative when activated for generating an acoustic alarm; actuatable switching means operative when manually actuated for producing an output; a timer for counting a predetermined short time beginning immediately when the generated acoustic alarm of said alarm sound generator has been stopped in response to one actuating action of said switching means and for producing an output when the counting has been completed; second means for effecting activation of said alarm sound generator to generate the acoustic alarm in response to the output of said timer; third means for compulsorily effecting activation of said alarm sound generator to generate the acoustic alarm in response to another actuating action of said switching means; another actuatable switching means operative when manually actuated for producing an output; another timer for counting a predetermined time beginning immediately when the coincidence output has been generated and for producing an output when the counting has been completed; fourth means for effecting resetting of said another timer to an initial condition in response to one actuating action of said another switching means; and fifth means for controlling said alarm sound generator in cooperation with the outputs from said two switching means and said two timers and for automatically terminating activation of said alarm sound generator after elapse of said predetermined time counted by said another timer if, during that predetermined time, neither said timer or said another timer are actuated.

* * * * *